US005553594A

United States Patent [19]

Ehlers et al.

[11] Patent Number: 5,553,594

[45] Date of Patent: Sep. 10, 1996

[54] CONTROLLABLE IGNITION SYSTEM

[75] Inventors: Karsten Ehlers, Wolfsburg-Neuhaus; Christoph Dömland, Wolfsburg; Andreas Sprysch, Braunschweig, all of Germany

[73] Assignees: Volkswagen AG, Wolfsburg; Deutsche Automobilgesellschaft mbH, Braunschweig, both of Germany

[21] Appl. No.: 291,535

[22] Filed: Aug. 16, 1994

[30] Foreign Application Priority Data

Aug. 25, 1993 [DE] Germany ..... 43 28 524.4

[51] Int. Cl.[6] ..... F02P 9/00

[52] U.S. Cl. ..... 123/609

[58] Field of Search ..... 123/609, 605, 123/620, 625, 655, 644, 416, 598

[56] References Cited

U.S. PATENT DOCUMENTS

| | | | |
|---|---|---|---|
| 4,309,973 | 1/1982 | Tamura | 123/609 |
| 4,380,989 | 4/1983 | Takaki | 123/644 |
| 4,441,479 | 4/1984 | Endo et al. | 123/605 |
| 4,469,082 | 9/1984 | Nishitoba et al. | 123/609 |
| 4,915,086 | 4/1990 | Ciliberto et al. | 123/609 |
| 5,060,623 | 10/1991 | McCoy | 123/605 |
| 5,143,553 | 9/1992 | Mukaihira et al. | 123/609 |

FOREIGN PATENT DOCUMENTS

| | | | |
|---|---|---|---|
| 2444242 | 4/1975 | Germany | 123/609 |
| 2455536 | 5/1976 | Germany | 123/609 |
| 2759154 | 7/1979 | Germany | 123/609 |
| 2759153 | 7/1979 | Germany | 123/609 |
| 3924985 | 2/1991 | Germany | 123/609 |
| 3928726 | 3/1991 | Germany | 123/609 |

*Primary Examiner*—Raymond A. Nelli
*Attorney, Agent, or Firm*—Spencer & Frank

[57] ABSTRACT

A method for controlling an ignition system for internal combustion engines where the sparking current together with the sparking period can be set to a particular value. The method described here makes it possible for each cylinder in the engine to be supplied with just the amount of ignition energy to meet the momentary requirement of the engine, and consequently a spark plug replacement interval of more than 100,000 km can be achieved. In accordance with the present invention, both the value of the sparking current and the value of its sparking period are controlled independently according to certain engine parameters, in particular load, engine speed and temperature. The method in accordance with the present invention can be applied preferably in an alternating current or high voltage capacitor ignition system.

12 Claims, 6 Drawing Sheets

CONTROLLABLE IGNITION SYSTEM

BACKGROUND OF THE INVENTION

The invention relates to a method for controlling an ignition system for internal combustion engines comprising at least one ignition output stage for the excitation of at least one ignition coil that generates a sparking current, and where the value of the sparking current and the sparking period can be set.

An ignition system of this kind is known from DE-OS 39 28 726 that has the advantage, compared with conventional ignition systems such as so-called transistorized ignition systems with inactive high-voltage distribution, of being able to employ small and therefore low-cost ignition coils. Furthermore, in accordance with the above-mentioned publication, optimum ignition is ensured because it remains switched on for the entire sparking period irrespective of engine speed. An ignition system of this kind is known as an alternating current ignition system because it generates a bipolar sparking current.

In the prior-art ignition concepts, the primary requirements were as follows: To ensure a reliable cold start and to reliably ignite the fuel/air mixture in the cylinder even if the spark plugs were sooty. In order to meet these requirements, a correspondingly large amount of ignition energy was made available. This ignition energy, which was designed to meet the maximum requirement of the engine, is not needed in normal operation (warm engine). Consequently, the electrode erosion of the spark plugs is unnecessarily high which in turn reduces the life of the spark plugs and results in frequent replacement of the spark plugs.

SUMMARY OF THE INVENTION

The object of the invention is to provide a method for controlling an ignition system as described at the outset such that the spark plug replacement intervals are no less than 100,000 km.

Pursuant to the invention, the value of the sparking current together with its sparking period is controlled according to engine parameters. Such an ignition process with controlled parameters results in considerably less erosion on the spark plugs than is the case with conventional serial ignition. Consequently, the spark plug replacement intervals are substantially lengthened.

In an advantageous further development of the method according to the invention, engine load, engine speed and engine parameters are used to control the ignition current as well as its sparking period. For this purpose, the use of families of characteristics stored in the control unit is preferred. Preferably, a base value for ignition current value and for the sparking period is derived from an ignition current family of characteristics or from a sparking period family of characteristics for the engine load and engine speed.

In accordance with another preferred embodiment, these base values for the ignition current value and the sparking period are corrected to suit the momentary operating state of the internal combustion engine. For instance, temperature compensation is performed if the engine temperature has not yet reached a particular threshold value. This improves the cold-start characteristic of the engine. Also, the base value for the ignition current value is modified by a dynamic factor when there is a dynamic change in the state of the engine. This factor is proportional to the change in the load value and diminishes with time. After a specific delay time, the dynamic factor reaches the value zero and the corrected base value assumes the base value for the new load state.

The method in accordance with the invention can be used to advantage in order to control alternating current or high voltage capacitor ignition systems.

BRIEF DESCRIPTION OF THE DRAWINGS

The method in accordance with the invention will now be described and explained on the basis of an alternating current ignition system for the purposes of example. The drawings show.

DESCRIPTION OF THE PREFERRED EMBODIMENTS

Figure 1:
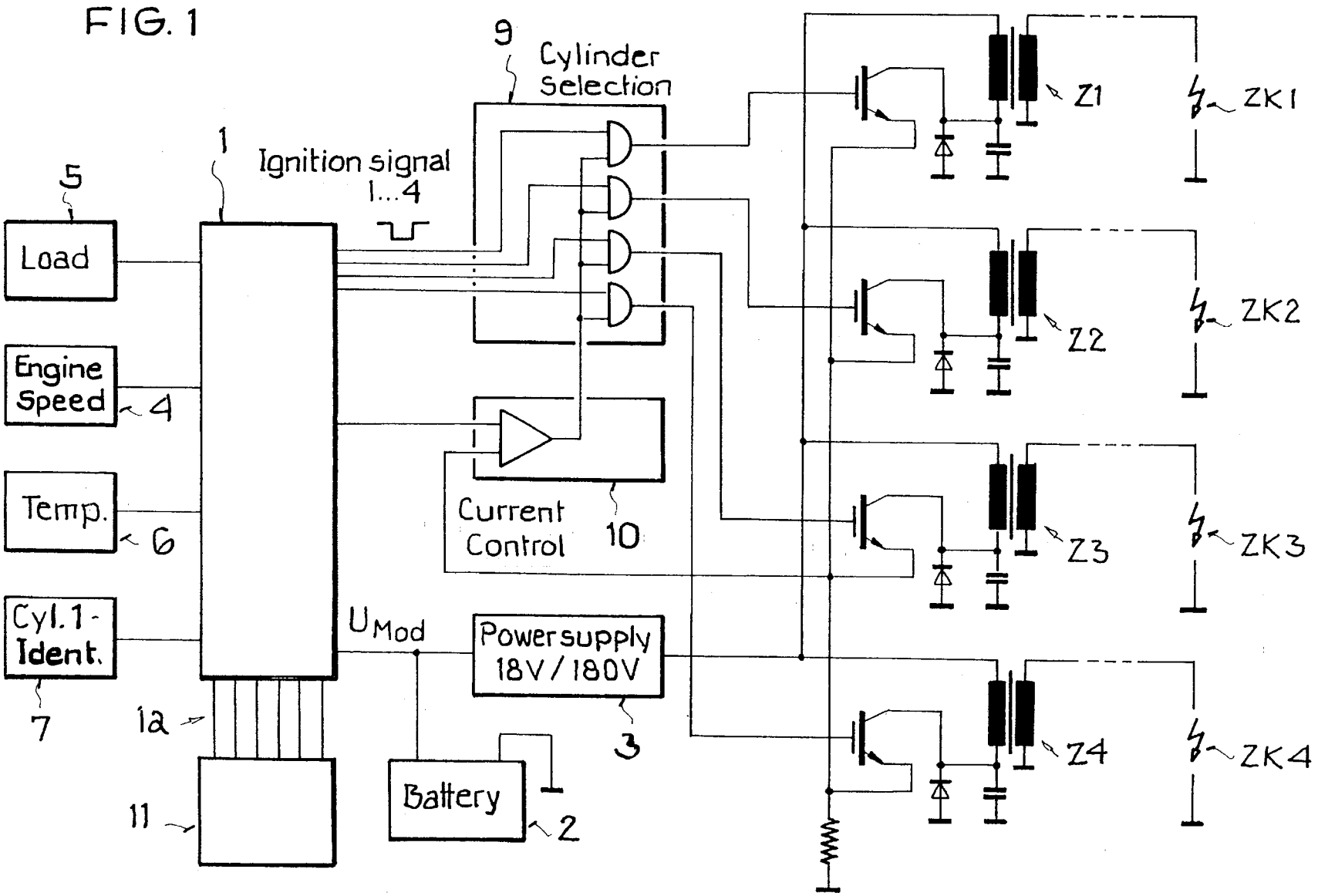
FIG. 1 A block diagram of an alternating current ignition system for performing the method in accordance with the invention.

FIG. 1 shows a block diagram of an alternating current ignition system for performing the method in accordance with the invention for a four cylinder engine. For each spark plug ZK1 there is one ignition output stage Z1–Z4. These ignition output stages are connected to a control unit 1 via a circuit 9 for cylinder selection. This control unit 1 generates a respective ignition signal 1 to 4 for each ignition end stage and at the same time outputs for all ignition output stages a modulation voltage $U_{Mod}$ which is processed from a current control circuit 10. This modulation voltage represents a setpoint value $I_{set}$ of the ignition current and is compared by means of a comparator with an actual value $I_{act}$ generated at a shunt resistor R (see FIG. 2) in the primary circuit of the ignition output stage. The result of the comparison is supplied to the cylinder selection circuit 9. Furthermore, the control unit 1 is connected to sensors 4, 5 and 6 for detecting the engine speed n, the load L and the engine temperature T and to a device 7 for identifying cylinder 1, and to an injection system 11, containing the requisite actuators, via leads 1*a* in order to control the electronic injection. Finally, a switched-mode power supply 3 generates the supply voltages (18 V/180 V) for the ignition output stages Z1–Z4 and which is powered from an on-vehicle battery 2.

Figure 2:
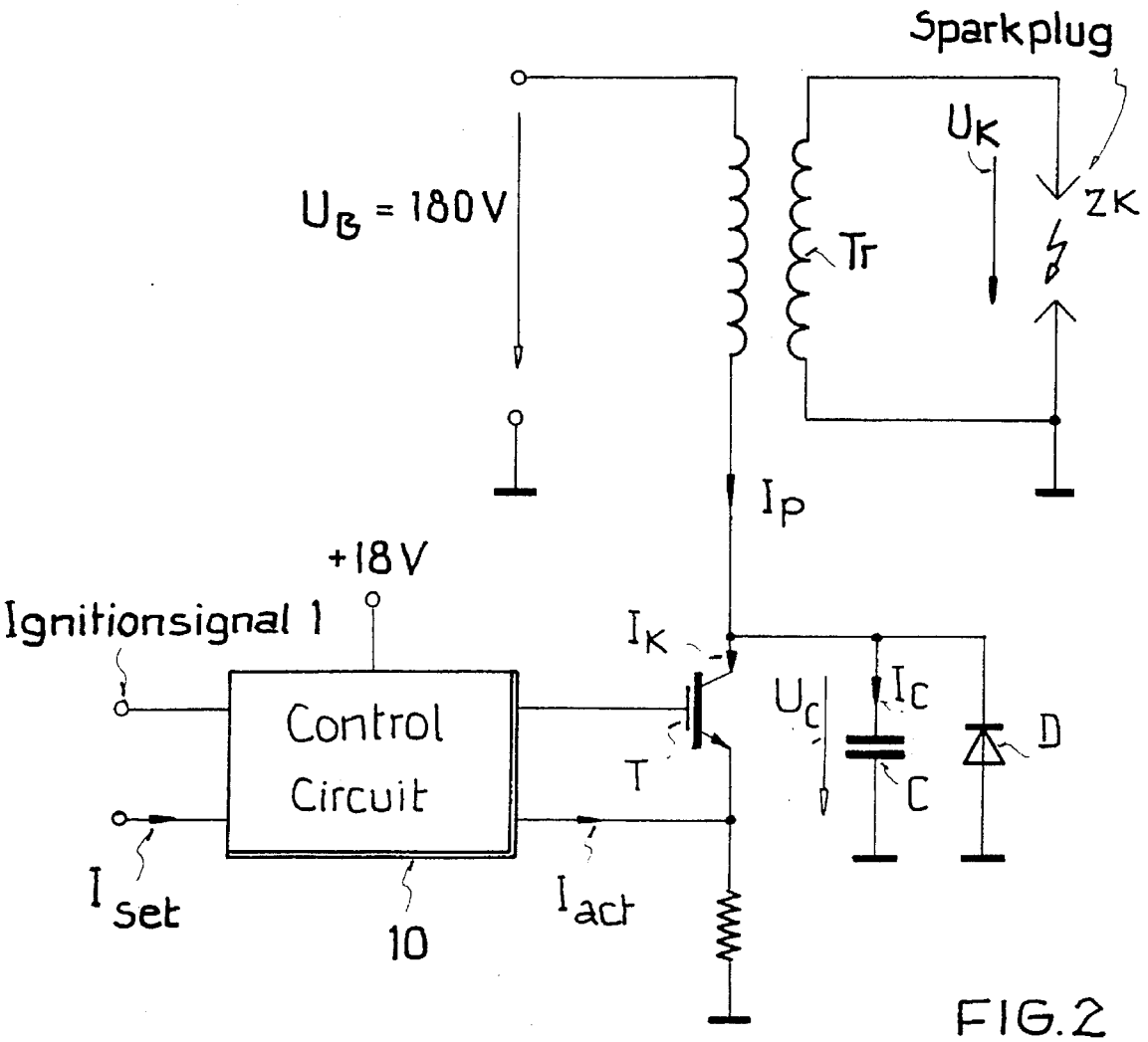
FIG. 2 A detailed circuit diagram for an ignition output stage in an alternating current ignition system in accordance with FIG. 1.

One example of embodiment of an ignition output stage for the excitation of a single ignition coil in accordance with FIG. 1 is shown in FIG. 2 and essentially comprises a transistor T of the IGBT (isolated gate bipolar transistor) type, an energy recovery diode D, a primary resonant circuit capacitor C, an ignition coil Tr made up of a primary and a secondary winding with a coupling of approx. 50%, a spark plug ZK, and a simple closed-loop control circuit 10 corresponding to the current control circuit 10 in accordance with FIG. 1 but containing in addition a gate of the cylinder selection circuit 9. This control circuit 10 is therefore supplied with the control signals conditioned by the control unit 1, namely the ignition signal 1 and the modulation voltage $U_{Mod}$. The former of these two control signals establishes the time of ignition and the sparking period $t_B$, whereas the control signal $U_{Mod}$ defines the value of the primary current $I_p$ and consequently the ignition voltage $U_K$ and hence the value of the sparking current $i_B$. The generation of these two control signals ignition signal 1 and $U_{Mod}$ in accordance with the invention will be described later in the text below.

The ignition output stage in accordance with FIG. 2 operates in the current-controlled reverse and forward converter mode. For the duration of the switch-on operation of transistor T, a collector current $I_k$ flows that corresponds to the primary coil current $I_p$ in accordance with FIG. 3. This collector current $I_k$ is limited by the closed-loop control circuit 10 to a value $I_{set}$ that is determined by the modulation voltage $U_{Mod}$. In order to obtain a short charging time, the ignition output stage is supplied with a voltage of 180 V from a switched-mode power supply that has already been explained in connection with FIG. 1. When the collector current $I_k$reaches the value specified by $I_{set}$, transistor T is switched off. The energy contained in the storage coil induces oscillation in the output circuit (secondary inductance, spark plug capacitance). Part of the energy is transferred to capacitor C and the other part to the spark plug capacitance. The voltages $U_C$ at capacitor C and the ignition voltage $U_B$ at the spark plug ZK rise sinusoidally (as shown in FIG. 3) until there is no longer any energy in the storage coil, i.e. the primary coil.

In the following period of time, the capacitively stored energy is returned to the primary coil inductance until the voltage $U_C$ at capacitor C reaches the value zero (see FIG. 3). The voltage $U_C$ on the primary side cannot become negative due to the diode D. On the secondary side, the oscillation continues because the coupling between primary and secondary inductances has a strength of only about 50%. During this period, transistor T is switched on again because the same voltage relationships now apply again as before switching on the transistor for the first time. The current control always guarantees the same amount of energy is supplied to the primary coil. The proportion of supplied energy that was not needed in the spark channel is returned in total to the on-vehicle electrical network. The coupling of approximately 50% prevents total damping of the primary resonant circuit (primary coil, capacitor C) when arcing occurs due to the highly damped secondary resonant circuit.

Figure 3:
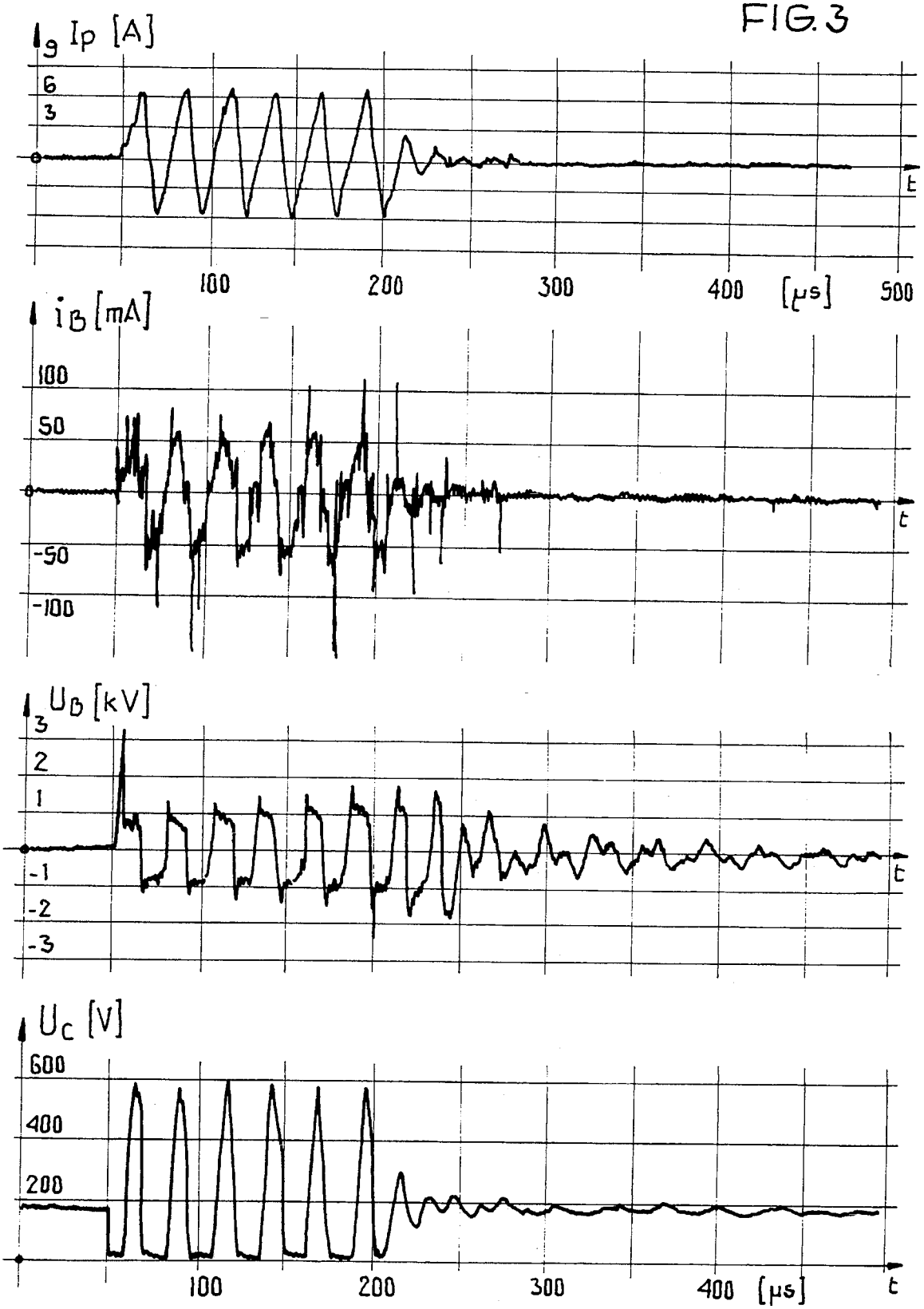
FIG. 3 Current/time and voltage/time charts for explaining the way in which the alternating current ignition system functions.

As can be seen from FIG. 3, the duration of the complete cycle (charging the primary coil, decay process until the voltage $U_C$ at capacitor C reaches zero) is approximately 80 μs. The charging time of the coil can therefore be neglected. Therefore, in contrast to the transistorized coil ignition system, no dwell angle control is required. Furthermore, the sparking period $t_B$ per ignition operation can be modified as required by varying the number of switching cycles. Modulation of the sparking current $i_B$ is accomplished by modifying the energy fed in on the primary side. Because of the non-ideal character of the current source in the output stage, however, not only does the sparking current become modified but at the same time also, in certain ranges, the secondary high voltage $U_K$ available at the Spark plug ZK. When the sparking current $i_B$ is reduced, attention must therefore also always be given to the drop in the maximum voltage.

This technique of the self-oscillating ignition output stage allows the volume of the ignition coil to be reduced considerably because, in contrast to the transistorized coil ignition system, it is not necessary for the entire energy for an ignition operation to be stored in the coil as it can be delivered successively in several small units. Therefore, only a reduced coil volume is needed to store the smaller amount of energy. Another advantage for the design of the ignition coil is the required coupling of only approximately 50% because this can be obtained with a simple rod core.

The control unit 1 is a microcontroller system, based for example on a Motorola chip MC68HC811E2, and is an 8-bit controller with internal EEPROM program memory. The power supply to this control unit 1 is taken from the on-vehicle electrical supply network which is fed from battery 2. In order to correctly activate the alternating current ignition system, the control unit 1 requires a signal giving the cylinder sequence (cylinder 1 identification 7 in accordance with FIG. 1). For this purpose, a magnet can be fitted to the toothed disk of the camshaft for example, and a Hall sensor can be used to detect it. This sensor delivers one signal every 360° of the camshaft or every 720° of the crankshaft, namely the cylinder 1 mark.

With the method according to the invention, the alternating current ignition system illustrated in FIG. 1 becomes an ignition system that allows the ignition energy to be controlled with the help of two parameters. The first parameter is the modulation voltage $U_{Mod}$ that enables the primary current $I_p$ (see FIG. 2) of the ignition coil to be automatically controlled. This current $I_p$ influences the high voltage $U_K$ of the secondary coil and the sparking current $i_B$ flowing between the electrodes of the spark plug. The signal is a high frequency PWM signal smoothed through an RC filter in the ignition output stage and provided for all four cylinders together as shown in FIG. 1. The control unit 1 has a PWM output for this purpose. In accordance with FIG. 1, the spark plugs in the various cylinders are ignited by the ignition signals 1 to 4. The sparking period $t_B$ of the ignition process represents the second parameter and is also determined by the control unit 1 and is provided by the pulse width of the respective ignition signal.

The coil excitation program stored in the control unit 1 for the ignition output stages is responsible firstly for the correct distribution of the ignition signals and secondly for the calculation of the optimum ignition parameters namely in the form of the modulation voltage $U_{Mod}$ and the sparking period $t_B$ and their output. Before activation of the ignition output stages can commence, the control unit 1 must be synchronized, i.e. it waits for the first signal from device 7 to identify cylinder 1 (see FIG. 1). An endless loop then follows in which all calculations are performed and which is repeated for each ignition process. An analog-to-digital conversion is performed in this loop in order to register the engine parameters, such as load and temperature, generated by sensors 5 and 6. The engine speed is obtained by analyzing the time gap between successive pulses from the engine speed sensor.

Figure 4:
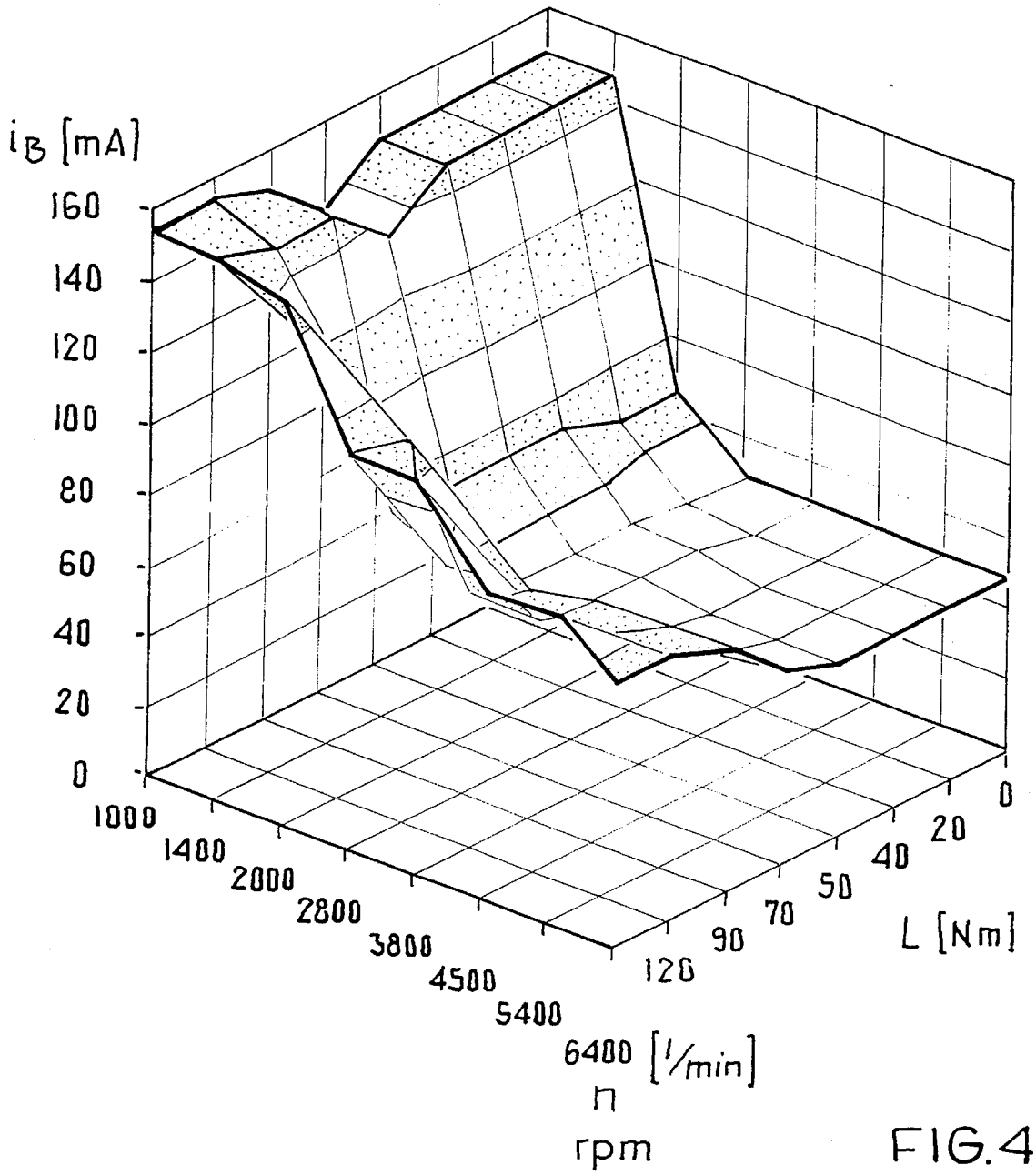
FIG. 4 A sparking current family of characteristics in accordance with the method pursuant to the invention.
Figure 5:
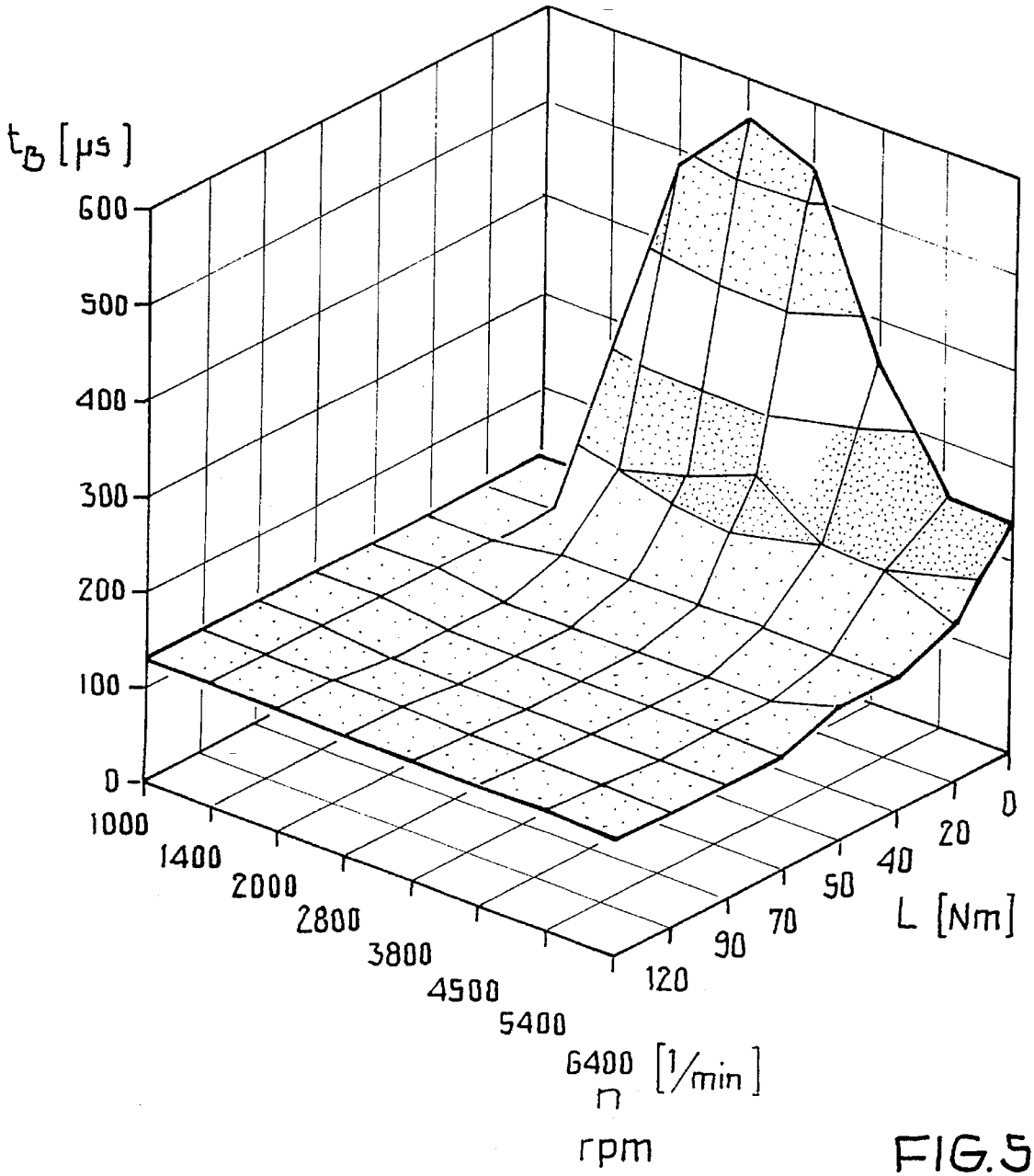
FIG. 5 An ignition time family of characteristics in accordance with the method pursuant to the invention.

The new ignition parameters are calculated on the basis of the engine load L (which is determined either by the position of the throttle valve potentiometer or by measuring the air flow in the intake pipe) and the engine speed n. For this purpose, the associated base values $U_{Base}$ and $t_{Base}$ of the modulation voltage $U_{Mod}$ and sparking period $t_B$ are taken from two families of characteristics stored in the memory of control unit 1. These two families of characteristics are shown in FIGS. 4 and 5, namely the sparking current family of characteristics and the ignition time family of characteristics. The design of these families of characteristics depends on the ignition energy requirement. The family of characteristics for the sparking current $i_B$ in accordance with FIG. 4 makes allowance for the offered current with a safety factor of 1.2. The maximum current is needed at idling speed irrespective of the load. When operating at full load, the necessary sparking current reduces gradually with the engine speed, whereas when operating at partial load or at no load the value reduces more rapidly and reaches the minimum of 40 mA already at medium engine speeds. In the family of characteristics for the sparking period, the minimum sparking period was established on a test rig. In the entire partial and full load zone, an ignition time (corresponding to one ignition pulse) of 120 μs was found to be sufficient. In the no-load zone, however, the sparking period must be lengthened considerably, especially at medium engine speeds. All working points shown with the two families of characteristics in accordance with FIGS. 4 and 5 are applicable for an engine that is running while the vehicle is stationary. The temperature and the dynamic behaviour of the engine are allowed for additionally by the control unit 1, as will be described below.

The base values $U_{Base}$ and $t_{Base}$ described above for the modulation voltage $U_{Mod}$ and sparking period $t_B$ are corrected according to the momentary operating state of the engine in the following way:

$$U_{Mod}=U_{Base}+U_{Temp}+U_{Dyn}$$

where $U_{Base}$ is the base value determined from the load/speed family of characteristics, $U_{Temp}$ the temperature correction value and $U_{Dyn}$ the dynamic correction value.

The temperature correction value is obtained from the following formula:

$$U_{Temp}=(T_{70^\circ C.}-T_{act})\cdot k_T$$

where $T_{70^\circ C.}$ is a specific threshold temperature, 70° C. for example, $T_{act}$ the actual engine temperature and $k_T$ a proportional factor. The temperature correction is therefore a proportional correction. This means that if the engine temperature falls below a specific threshold value, for instance 70° C., a factor $U_{Temp}$ is calculated by which the modulation voltage $U_{Mod}$ is increased. This factor $U_{Temp}$ is proportional to the difference between engine temperature and the temperature threshold value. When the engine is warm, this correction is not performed.

When there is a dynamic change to the operating state of the engine, a high voltage that has been increased by the dynamic correction factor $U_{Dyn}$ is offered for a short time. This factor $U_{Dyn}$ is obtained from the following formula:

$$U_{Dyn}=(L_{act}-L_{old})\cdot k_B+U_{Dyn,old}\cdot k_{B-1}$$

where $L_{act}$ is the actual load value and $L_{old}$ the load value before the operating state changed. $k_B$ and $k_{B-1}$ are proportional factors that are determined by practical road trials. After a change in load, the modulation voltage $U_{Mod}$ rises by this dynamic factor $U_{Dyn}$ which is proportional to the change in the load signal and which reduces with time. After a delay time of, for example, 2 seconds, the value of this factor $U_{Dyn}$ has dropped to zero which causes the modulation voltage $U_{Mod}$ to reach the new static base value for the new load state.

The procedure for calculating the sparking period $t_B$ is similar. Starting with the base value $t_{Base}$ described above, only a temperature correction is performed in accordance with the following formula:

$$t_B=t_{Base}+t_{Temp}$$

where $t_{Base}$ is the base value of the sparking period derived from the load/speed family of characteristics and the temperature correction value $t_{Temp}$ is calculated with the following formula:

$$t_{Temp}=(T_{70^\circ C.}-T_{act})\cdot k_{Tt}$$

where $T_{70^\circ}$ C.represents a specific threshold value, for example 70° C., and $T_{act}$ the actual engine temperature, while $k_{Tt}$ is a proportionality factor as in the case of the corresponding temperature correction of the modulation voltage $U_{Temp}$. Also when calculating the sparking period $t_B$, allowance is made for the temperature only when the engine temperature $t_{act}$ is below the threshold temperature of, for example, 70° C.

Trials performed with the alternating current ignition system described above in an experimental vehicle showed after a travelled distance of 15,000 km that the spark plug electrodes had eroded by 0.03 mm compared with 0.09 mm on spark plugs with a conventional serial ignition system. In a pressure chamber, the spark plug operating voltages rose merely by 3.7 kV and 2.7 kV respectively compared with 5.5 kV and 4.5 kV respectively on spark plugs with a serial ignition system. The results of the gap measurements show that the life of the spark plugs can be expected to be more than three times as long.

Figure 6:
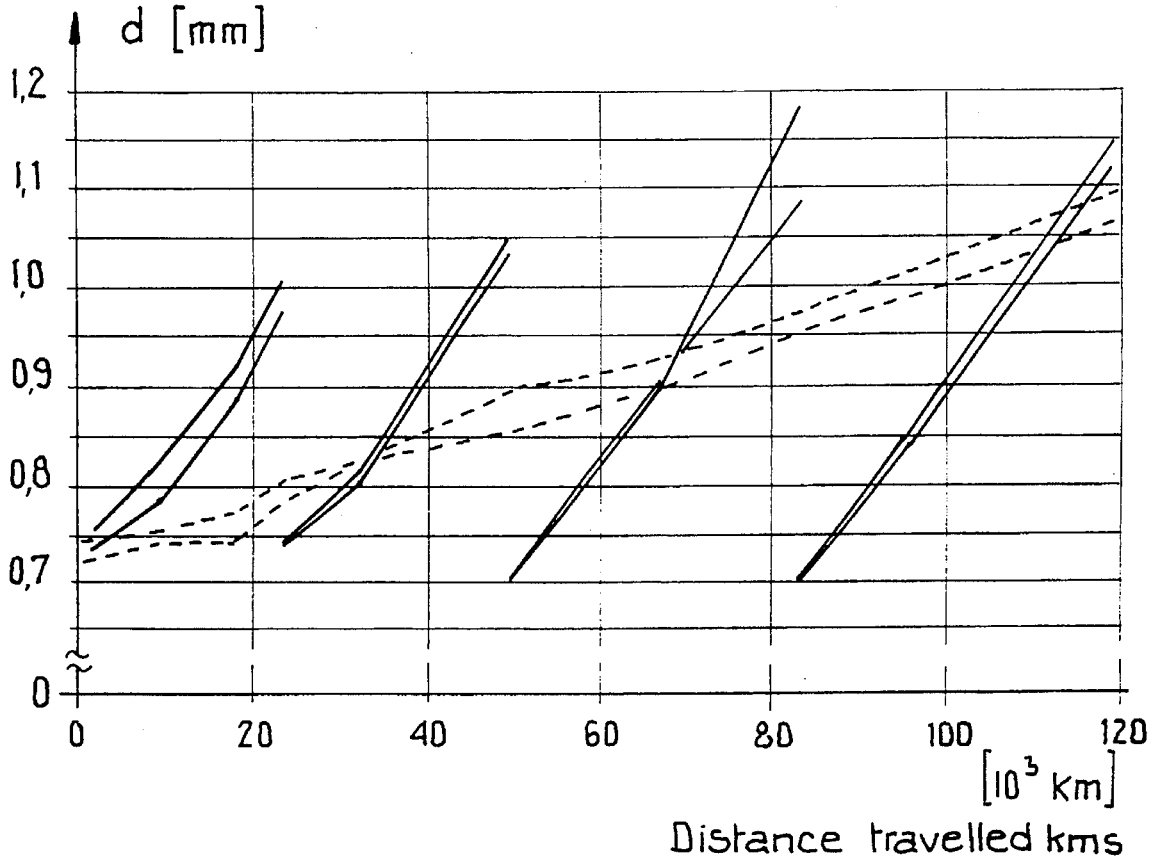
FIG. 6 A chart showing the electrode erosion as a function of the distance travelled.

Finally, an endurance test revealed correspondingly good results as shown in FIG. 6. At the end of this test, the distance travelled with the spark plugs operated with the alternating current ignition system described above corresponded to 120,000 km (represented by the broken line in FIG. 6). Over the same period of time, the spark plugs operated with a conventional serial ignition system (represented in FIG. 6 by full lines) had to be replaced four times because in each case they had reached the limit of wear, i.e. on changing the load single spark failures were detected. The spark plugs with the alternating current ignition system could still have been used had the test been resumed.

The electrode erosion in these spark plugs was less by a factor of 3.9 than that in the spark plugs operated with the serial ignition system.

The alternating current ignition system also satisfies the tougher requirements imposed on future ignition systems due to the control of ignition by means of a family of characteristics in accordance with the invention. In particular, optimized combustion can be expected to result in improved exhaust gas values. The use of the method in accordance with the invention is also conceivable in future lean engines by means of an extended sparking time.

The alternating current ignition system in accordance with the invention is optimally adapted to the varying ignition energy requirement of the engine without sacrificing operational reliability.

What is claimed is:

1. A method for controlling an ignition system for an internal combustion engine comprising at least one ignition output stage for the excitation of at least one ignition coil that generates a sparking current, and wherein the value of the sparking current and the sparking current can be set; said method including the steps of: determining momentary values of various operating parameters of the internal combustion engine during operation of the engine; and independently controlling the value of the sparking current and the value of its sparking period according to the determined values of the engine parameters during normal operation of the engine.

2. A method in accordance with claim 1, wherein the engine parameters correspond to the engine load, the engine speed and the engine temperature.

3. A method in accordance with claim 2, wherein said step of independently controlling includes determining the respective values of the sparking current and, of it sparking period utilizing the values of the engine parameters and stored families of operating characteristics for the engine.

4. A method in accordance with claim 3, wherein said step of determining the respective values includes deriving a base value for the value of the sparking current from an ignition current family of characteristics for the engine load and engine speed.

5. A method in accordance with claim 4, wherein said step of determining the respective values includes deriving a base value for the sparking period from a sparking period family of characteristics for the engine load and engine speed.

6. A method in accordance with claim 5, wherein said step of determining the respective values further includes correcting the respective base values for the sparking current and the sparking period according to the momentary values of the engine parameter corresponding to the momentary operating state of the internal combustion engine.

7. A method in accordance with claim 6, wherein said step of correcting includes performing a temperature correction according to the momentary value of the engine temperature.

8. A method in accordance with claim 7, wherein said step of correcting includes subjecting the base value for the value of the sparking current to a dynamic correction when there is a dynamic change to the operating state of the internal combustion engine.

9. A method in accordance with claim 8, wherein said step of subjecting includes increasing the base value for the value of the sparking current after a change in load by a dynamic factor that is proportional to the change in load value and that diminishes with time.

10. A method in accordance with claim 9, wherein the dynamic factor reaches a value zero after a certain delay time, while the corrected base value assumes the base value for the new load state.

11. A method in accordance with claim 10 used for controlling an alternating current ignition system.

12. A method in accordance with claim 10 used for controlling a high voltage capacitor ignition system.

* * * * *